US005588307A

United States Patent [19]

Schmidt

[11] Patent Number: 5,588,307

[45] Date of Patent: Dec. 31, 1996

[54] PROCESS FOR LIQUEFACTION OF A PRESSURIZED HYDROCARBON-RICH FRACTION

[75] Inventor: Hans Schmidt, Wolfratshausen, Germany

[73] Assignee: Linde Aktiengesellschaft, Germany

[21] Appl. No.: 556,192

[22] Filed: Nov. 9, 1995

[30] Foreign Application Priority Data

Nov. 11, 1994 [DE] Germany ..... 44 40 406.9

[51] Int. Cl.[6] ..... F25J 1/00

[52] U.S. Cl. ..... 62/614; 62/636; 62/912

[58] Field of Search ..... 62/614, 636, 912

[56] References Cited

U.S. PATENT DOCUMENTS 3,878,689 4/1975 Grenci ..... 62/614

4,133,663 1/1979 Skinner ..... 62/636

4,229,195 10/1980 Förg ..... 62/23

5,006,138 4/1991 Hewitt ..... 62/636

*Primary Examiner*—Ronald C. Capossela

*Attorney, Agent, or Firm*—Millen, White, Zelane, & Branigan, P.C.

[57] ABSTRACT

A pressurized hydrocarbon-rich fraction is cooled and liquefied by heat exchange with the process flows to be heated. Thereafter, the fraction is expanded in an expansion valve and introduced into a storage tank. The flash gas/boil-off gas removed from the storage tank, which optionally forms one of the process flows to be heated, is compressed in one or more stages. The throughput of the flash gas/boil-off gas compressor is kept constant at full load via the position of the expansion valve or expansion turbine controlled by means of a FIC controller. The pressure following expansion valve or expansion turbine is kept substantially constant.

21 Claims, 1 Drawing Sheet

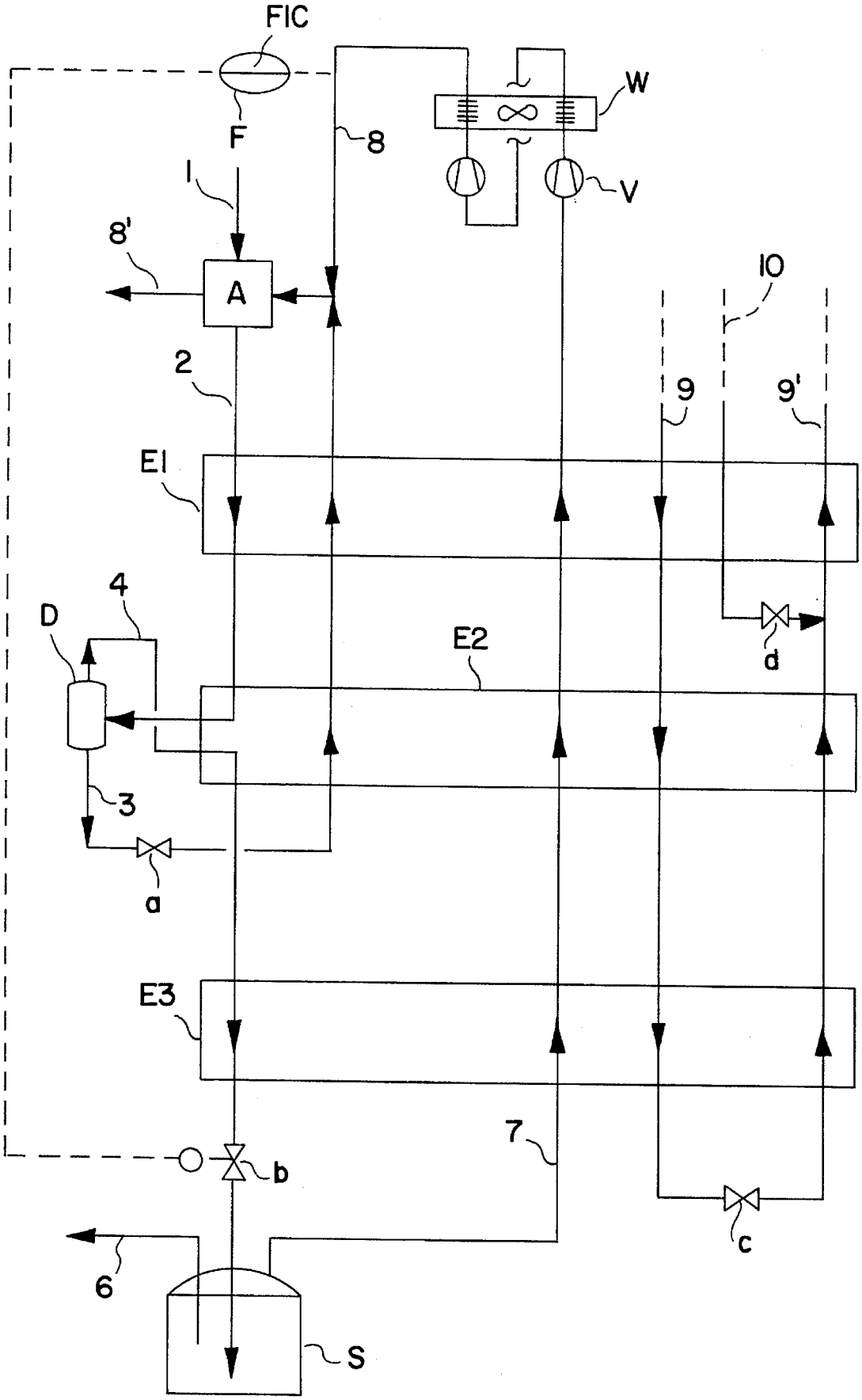
FIC
F
W
8
V
I
8'
A
10
2
9
9'
E1
4
D
E2
d
3
a
E3
7
b
c
6
S

PROCESS FOR LIQUEFACTION OF A PRESSURIZED HYDROCARBON-RICH FRACTION

SUMMARY OF THE INVENTION

The invention relates to liquefaction of a pressurized hydrocarbon-rich fraction in which the fraction is cooled and liquefied by heat exchange with process flows to be heated. Thereafter, the fraction is expanded by means of an expansion valve into a storage tank, and boil-off gas, which emerges from the storage tank and which optionally forms one of the process flows to be heated, is compressed in one or more stages.

Above and below, the expression "boil-off gas" refers to the gas "boiled off" due to heat exchange between the storage tank and its surrounding environment. The gas within the storage tank or tank return gas also contains flash gas formed during expansion of the hydrocarbon-rich fraction into the storage tank.

A host of processes for liquefaction of a pressurized hydrocarbon-rich fraction, especially natural gas, are known. Thus, for example, a process for liquefaction of natural gas is known from DE-OS 28 20 212 (see also U.S. Pat. No. 4,229,195), in which a pressurized natural gas flow is brought into heat exchange with two refrigerants circulated in two closed circuits. The refrigerant of the first circuit is used for precooling the natural gas and for cooling the refrigerant of the second circuit. The latter is used for liquefaction of the precooled natural gas.

The flash gas formed in the process is subjected to heat exchange with precooled natural gas, combined with boil-off gas and compressed, liquefied at least partially in heat exchange with the refrigerants of the first and the second circuit and then expanded again. However, in this process, the flash gas/boil-off gas compressors operate independently of the plant burden. The liquid natural gas obtained in this process is stored in large storage tanks. Storage is generally done under atmospheric pressure. Depending on the ambient temperature, so-called boil-off gas is continually formed within these storage tanks. The boil-off gas is withdrawn from these storage tanks and combined with the flash gas before being delivered to single or multistage compression, eventually after heating.

As already mentioned, the flash gas/boil-off gas compressors are operated independently of the plant. Thus, at times when the amount of boil-off gas formed is low, the internal pressure in the storage tank and thus the compressor intake pressure are reduced by the compressors, the compressors are operated under partial load or they shut down. This leads to a reduction in the amount of liquefied natural gas which is delivered to the storage tank due to the higher portion of flash gas formed resulting from the lower storage gas pressure, on one hand, and due to the lower tank return gas flow rate at partial load of the compressors on the other hand.

An object of the invention is to provide a process in which, for a given refrigerant circuit, the maximum possible amount of hydrocarbon-rich fraction can at any time be delivered to a storage tank via an expansion valve.

Upon further study of the specification and appended claims, further objects and advantages of this invention will become apparent to those skilled in the art.

These objects are achieved in accordance with the invention by keeping the throughput of the flash gas/boil-off gas compressor constantly at full load by controlling the position of an expansion valve by means of a FIC controller. As a result, the pressure after the expansion valve is kept constant.

BRIEF DESCRIPTION OF THE DRAWING

Various other objects, features and attendant advantages of the present invention will be more fully appreciated as the same becomes better understood when considered in conjunction with the accompanying drawing, in which like reference characters designate the same or similar parts throughout the several views, and wherein:

FIG. 1 illustrates an embodiment of the process in accordance with the invention.

DETAILED DESCRIPTION

The invention as well as further embodiments thereof are detailed using the Figure.

The pressurized hydrocarbon-rich fraction is preferably at a pressure of 20–70 bar, especially 30–50 bar, and preferably a temperature of 20°–40° C. The hydrocarbon-rich fraction generally contains hydrocarbons such as methane, ethane and $C_{3+}$ hydrocarbons and aromatics, as well as other components such as $CO_2$, $H_2O$ and $N_2$. For example, the hydrocarbon content of the fraction is preferably 80–99 mole %, especially 90–98 mole %. The pressurized hydrocarbon-rich fraction can, for example, be a pressurized natural gas stream.

The pressurized hydrocarbon-rich fraction is delivered via line 1 to adsorption zone A, e.g., at least two molecular sieve bed adsorbers each operated cyclically through adsorption and desorption/regeneration phases. In the latter, components which can be frozen out, especially carbon dioxide and water, are removed from the hydrocarbon-rich fraction such that the amounts of these components still contained therein cannot lead to blockages of lines and/or valves within the cold part of the plant.

The pre-purified, hydrocarbon-rich fraction is cooled in counterflow by process flows to be heated in heat exchangers E1 and E2 and partially liquefied. After removal from heat exchanger E2, the fraction is delivered to separator D in which $C_{3+}$ hydrocarbons and aromatics are removed. The $C_{3+}$ hydrocarbons and aromatics are withdrawn from the bottom of separator D via line 3, expanded in valve a for refrigeration purposes and then routed, in counterflow to the hydrocarbon-rich fraction to be cooled, through heat exchangers E2 and El.

The hydrocarbon-rich fraction from which the aforementioned components have been removed is withdrawn via line 4 at the top of the separator, further cooled in heat exchangers E2 and E3, whereby it is finally entirely liquefied and supercooled. Via expansion valve or expansion turbine b, the liquefied hydrocarbon-rich fraction is expanded to the internal pressure of storage tank S. The pressure of the hydrocarbon-rich fraction stored in storage tank S is roughly 1 bar, e.g., about 1.01–1.10 bar. Liquefied hydrocarbon-rich fraction can be removed from storage tank S via line 6.

Boil-off gas formed within storage tank S and flash gas resulting from expansion in valve b are removed from storage tank S via line 7 and optionally heated in heat exchangers E3, E2 and E1 against the hydrocarbon-rich fraction to be cooled. Finally, the flash/boil-off gas or tank return gas is supplied to at least one compressor V. After each compressor stage, the flash/boil-off gas is cooled by means of another heat exchanger W. According to the design of the plant in which the process according to the invention is used, single- or multistage compression of the flash/boil-off gas is feasible. The compressed flash/boil-off gas is then delivered via line 8 together with the fraction from line 3 to adsorption zone A as regeneration gas. The regeneration gas, loaded with the components adsorbed from the adsorption agent, is removed from adsorption zone A by means of line 8'.

The demand for refrigeration needed for cooling and liquefaction of the hydrocarbon-rich fraction is covered by means of an additional refrigeration circuit. This refrigeration circuit is shown here only schematically. Via lines 9 and 10, the refrigerant or refrigerant mixture is routed through heat exchanger El, E2 and E3, to provide cooling and partial liquefaction. Line 9 is a vapor refrigerant line and line 10 is a liquid refrigerant line. The refrigerant or refrigerant mixture is expanded for refrigeration purposes in expansion valves c and d and then is routed by means of line 9' in counterflow to the hydrocarbonrich fraction to be cooled through heat exchangers E3, E2 and El. Mixtures of nitrogen and methane or mixtures of nitrogen, methane and $C_2$ through $C_5$ hydrocarbons can be used as refrigerants. These refrigeration circuits are known in the art and thus are not described in detail here.

The process according to the invention ensures that the internal pressure of storage tank S is optimum at any time. This means that the maximum possible amount of hydrocarbon-rich fraction can always be delivered to storage tank S and stored in it.

The capacity and pressure ratio of compressor V are established according to design conditions.

If the ambient temperature drops and less boil-off gas is produced, and thus less tank return gas, the compressor will automatically reduce the pressure in the storage tank S to the allowed minimum pressure and then start to operate in partial load mode or even shut down. The same applies for changes in the feed gas composition, pressure or temperature downstreams of the adsorption zone A.

If the pressure ratio and the flow rate through compressor V are kept at design for such changes, expansion valve or expansion turbine b opens according to the FIC set-point, thereby increasing the liquefied natural gas flow rate into the storage tank S.

Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

In the foregoing, all temperatures are set forth uncorrected in degrees Celsius and unless otherwise indicated, all parts and percentages are by weight.

The entire disclosure of all applications, patents and publications, cited above, and of corresponding German application P 44 40 406.9, filed Nov. 11, 1994, are hereby incorporated by reference.

The preceding can be repeated with similar success by substituting the generically or specifically described reactants and/or operating conditions of this invention for those used therein.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for liquefaction of a pressurized gas stream containing hydrocarbons comprising:

cooling and liquefying a pressurized hydrocarbon-rich gas stream by heat exchange with process streams to be heated, expanding the resultant liquefied stream by means of at least one expansion means into at least one storage tank, and removing flash gas/boil-off gas stream from said at least one storage tank and compressing said flash gas/boil-off gas stream in at least one compression stage, wherein throughput of said flash gas/boil-off gas stream in said at least one compression stage is kept constant by controlling the position of said at least one expansion valve or expansion turbine by an FIC controller, whereby pressure immediately downstream of said at least one expansion means is maintained substantially constant.

2. A process according to claim 1, wherein said flash gas/boil-off gas stream is heated by heat exchange with said hydrocarbon-rich gas stream prior to compression.

3. A process according to claim 2, wherein, before liquefying said hydrocarbon-rich gas stream, components capable of being frozen out are removed from said hydrocarbon-rich gas stream in an adsorption zone and compressed flash gas/boil-off gas is used to regenerate said adsorption zone.

4. A process according to claim 1, wherein, before liquefying said hydrocarbon-rich gas stream, components capable of being frozen out are removed from said hydrocarbon-rich gas stream in an adsorption zone and compressed flash gas/boil-off gas is used to regenerate said adsorption zone.

5. A process according to claim 3, wherein said adsorption zone comprises at least two molecular sieve bed adsorbers, each operated cyclically through adsorption and desorption/regeneration phases.

6. A process according to claim 3, wherein, during cooling of said hydrocarbon-rich gas stream, said hydrocarbon-rich gas stream is delivered to a separator, a $C_{3+}$ hydrocarbon stream is removed from the bottom of said separator, and the remainder of said hydrocarbon-rich gas stream is removed from the top of said separator and cooled by further heat exchange with process streams to be heated prior to being delivered to said at least one storage tank.

7. A process according to claim 6, wherein said $C_{3+}$ hydrocarbon stream is heated by heat exchange with said hydrocarbon-rich gas stream, combined with said compressed flash gas/boil-off gas to form a gas mixture, and said gas mixture is used to regenerate said adsorption zone.

8. A process according to claim 3, wherein carbon dioxide is removed from said hydrocarbon-rich gas stream within said adsorption zone.

9. A process according to claim 5, wherein water is removed from said hydrocarbon-rich gas stream within said adsorption zone.

10. A process according to claim 3, wherein water is removed from said hydrocarbon-rich gas stream within said adsorption zone.

11. A process according to claim 1, wherein during cooling of said hydrocarbon-rich gas stream, said hydrocarbon-rich gas stream is delivered to a separator, a $C_{3+}$ hydrocarbon stream is removed from the bottom of said separator, and the remainder of said hydorcarbon-rich gas stream is removed from the top of said separator and cooled by further heat exchange with process streams to be heated prior to being delivered to said at least one storage tank.

12. A process according to claim 8, wherein said $C_{3+}$ hydrocarbon stream removed from the bottom of said separator is expanded and then subjected to heat exchange with said pressurized hydrocarbon-rich gas stream.

13. A process according to claim 1, wherein said flash gas/boil-off gas is compressed in multiple stages and cooled in a heat exchanger after each compression stage.

14. A process according to claim 1, wherein said hydrocarbon-rich gas stream is pressurized natural gas.

15. A process according to claim 1, wherein said at least one expansion means is at least one expansion valve.

16. A process according to claim 1, wherein said at least one expansion means is at least one expansion turbine.

17. A process according to claim 14, wherein said at least one expansion means is two expansion turbines.

18. A process according to claim 1, wherein said pressurized hydrocarbon-rich gas stream has a pressure of 20–70 bar and a temperature of 20°–40° C. prior to said heat exchange with process streams to be heated.

19. A process according to claim 1, wherein said pressurized hydrocarbon-rich gas stream has a hydrocarbon content of 80–99 mole %.

20. A process according to claim 1, wherein the pressure in said at least one storage tank is 1.01–1.10 bar.

21. A process according to claim 1, wherein said pressurized hydrocarbon-rich gas stream also undergoes heat exchange with a refrigeration circuit during said cooling and liquefying.

* * * * *